US010433683B2

(12) United States Patent
Beadles et al.

(10) Patent No.: US 10,433,683 B2
(45) Date of Patent: Oct. 8, 2019

(54) DISPOSABLE TOILET SEAT COVER AND BOWL SANITIZER

(71) Applicants: Robert Dale Beadles, Lodi, CA (US); Sam Fant, Lodi, CA (US)

(72) Inventors: Robert Dale Beadles, Lodi, CA (US); Sam Fant, Lodi, CA (US)

( * ) Notice: Subject to any disclaimer, the term of this patent is extended or adjusted under 35 U.S.C. 154(b) by 0 days.

(21) Appl. No.: 15/683,545

(22) Filed: Aug. 22, 2017

(65) Prior Publication Data

US 2019/0059663 A1 Feb. 28, 2019

(51) Int. Cl.
*A47K 13/16* (2006.01)
*A47K 13/24* (2006.01)

(52) U.S. Cl.
CPC ..... *A47K 13/16* (2013.01); *A47K 13/24* (2013.01)

(58) Field of Classification Search
CPC ..... A47K 13/16; A47K 13/24
USPC ..... 4/245.8
See application file for complete search history.

(56) References Cited

U.S. PATENT DOCUMENTS 1,835,787 A * 12/1931 Knisely ..... A47K 13/16 4/245.9
4,908,262 A * 3/1990 Nelson ..... A47K 13/14 4/245.6
7,247,360 B1 * 7/2007 Besner ..... A47K 13/16 4/245.1
2007/0209099 A1 * 9/2007 Issachar ..... A47K 13/18 4/245.1
2015/0359393 A1 * 12/2015 West, Jr. ..... A47K 13/16 4/245.8
2016/0206159 A1 * 7/2016 Pang ..... A47K 13/14

* cited by examiner

*Primary Examiner* — Huyen D Le
(74) *Attorney, Agent, or Firm* — Franklin & Associate International Inc; Matthew F. Lambrinos

(57) ABSTRACT

A disposable toilet seat cover/sanitizer includes a base layer and a barrier layer adjacent thereto, the disposable toilet seat cover/sanitizer having at least at least one portion thereof treated with a detergent and/or a disinfectant, the at least one treated portion is generally centrally arranged and is surrounded by a non-treated portion, the treated and non-treated portions are delimited by a perforation, the treated portion being detachable from the disposable toilet seat cover/sanitizer, thereby creating a central opening in the untreated portion. A method is also provided for preparing a toilet seat cover/sanitizer, the method includes: providing a substrate or base layer; treating, at least partially, the substrate with a detergent and/or a disinfectant; applying a barrier layer to a side of the base layer opposite to the side that was treated with the detergent and/or disinfectant; providing perforations around the treated portion, thereby defining a boundary between the seat cover portion the sanitizing portion; and packaging the cover/sanitizer.

12 Claims, 10 Drawing Sheets

DISPOSABLE TOILET SEAT COVER AND BOWL SANITIZER

TECHNICAL FIELD

The invention relates generally to sanitizing devices. Embodiments also relate to toilet seat covers of the kind that when placed in situ effectively isolate an individual's skin from any contact with the toilet seat, and is easily disposable following use. More particularly, some embodiments are directed to a disposable, water-soluble protective toilet seat cover and sanitizer.

BACKGROUND

It is known that public restrooms and toilets are frequently not kept as clean and sanitary as basic hygiene standards require. This is particularly true of toilets and toilet seats that must be used by multiple persons. The toilet seats may be soiled or wet and/or may contain disease-causing bacteria and viruses.

A user generally has no choice but to use such facilities and may attempt to wipe the seat with toilet paper or other tissue. Additionally, a user may use toilet paper to cover the seat to provide a barrier between the user and the seat. This attempt is usually unsatisfactory because the toilet paper has a tendency to move during use. Moreover, toilet paper is absorbent; therefore, any moisture from the seat will soak through and contact the skin of the user. Furthermore, toilet paper on the seat does not solve the problem of wet or dirty toilet seats.

Some restrooms have paper toilet seat covers that may be used on the toilet seat. These covers are made of paper and are shaped to fit the shape of the seat. After use, the paper is flushed down the toilet. However, the paper has a tendency to slide over the surface of the seat and not stay in place. In addition, since these covers are flushable, moisture may also soak through the paper to the skin of the user. To prevent this, some seat covers are oversized to drape down the sides of the toilet bowl; others recommend adhering the cover to the toilet seat. Thus, paper seat covers do not provide satisfactory results of keeping the user clean and dry when using a public toilet.

Moreover, users of public restrooms are often subjected to toilets having bowls that have not been cleaned after the previous user. Often, the bowl is unclean and possibly a health hazard. It is impractical to expect that a public restroom should be cleaned after each use. It is also highly impractical to expect users to clean a toilet bowl after using it.

Accordingly, there is a need for a toilet bowl cover/bowl sanitizing system that is easy to use and effective.

SUMMARY

According to one aspect, the present technology is a disposable toilet seat cover/sanitizer. The disposable toilet seat cover/sanitizer may comprise: a layer, the disposable toilet seat cover/sanitizer having at least at least one portion thereof treated with a detergent and/or a disinfectant, the at least one treated portion being generally centrally arranged, the layer having perforations or frangible zone, wherein the perforations or fragile zone is configured to allow at least part of the treated portion to be at least partially detached from the disposable toilet seat cover/sanitizer, thereby creating a central opening.

According to another aspect of the present technology, a disposable toilet bowl sanitizer for introduction into a toilet bowl is provided. The disposable toilet bowl sanitizer may comprise: at least one sanitizing portion, said at least one sanitizing portion comprising a substrate layer wherein said substrate layer is treated with a detergent and/or a disinfectant.

According to another aspect, the present technology is directed to a disposable toilet seat cover/sanitizer including a base layer and a barrier layer adjacent thereto. The disposable toilet seat cover/sanitizer has at least at least one portion thereof treated with a detergent and/or a disinfectant, the at least one treated portion is generally centrally arranged and is surrounded by a non-treated portion. The treated and non-treated portions are delimited by a perforation or frangible zone; the treated portion is configured to be detached from the disposable toilet seat cover/sanitizer, thereby creating a central opening in the untreated portion.

Further, in another embodiment, the present disclosure is directed to a disposable toilet bowl sanitizer configured to be introduced into a toilet bowl. The disposable toilet bowl sanitizer includes a base layer and a barrier layer adjacent thereto and is treated with a detergent and/or a disinfectant.

According to another aspect, a method for preparing a toilet seat cover/sanitizer may comprise: providing at least one substrate or layer portion; treating, at least partially, the at least one substrate or portion with a detergent and/or a disinfectant, the detergent and/or a disinfectant being locally absorbed into the material of the substrate or layer portion; providing perforations or a frangible zone around at least part of the treated portion, the perforations or frangible zone and packaging the cover/sanitizer.

In some embodiments of the method, the detergent and/or disinfectant is selected from the group consisting of: surfactants, isopropyl alcohol, sodium hypochlorite, alkyl dimethyl benzyl ammonium chloride, alkyl dimethyl ethylbenzyl ammonium chloride; triclosan; and combinations thereof In some embodiments, the method further comprises spraying, spot application or rolling the detergent and/or disinfectant to the substrate or layer portion.

In another embodiment, the present disclosure is directed to a method for preparing a toilet seat cover/sanitizer. The method includes: providing a substrate or base layer; treating, at least partially, the substrate with a detergent and/or a disinfectant, the detergent and/or a disinfectant being locally absorbed into the material of the base layer; applying a barrier layer to a side of the base layer opposite to the side that was treated with the detergent and/or disinfectant; providing perforations around the treated portion, the perforation thereby defining a boundary between the seat cover portion the sanitizing portion; and packaging the cover/sanitizer.

In a yet further embodiment, the present disclosure is directed to a hygienic restroom kit including a container containing therein at least one disposable toilet seat cover/sanitizer according to any one of the aforementioned aspects or embodiments. In some embodiments, the at least one disposable toilet seat cover/sanitizer contained in the container has a base layer and a barrier layer adjacent thereto. The at least one disposable toilet seat cover/sanitizer can have at least at least one portion thereof treated with a detergent and/or a disinfectant. The at least one treated portion may be generally centrally arranged and is surrounded by a non-treated portion; the treated and non-treated portions are delimited by a perforation or frangible zone. The treated portion may be configured to be detached from the disposable toilet seat cover/sanitizer, thereby creating a central opening in the untreated portion.

BRIEF DESCRIPTION OF THE DRAWINGS

The following detailed description of the preferred embodiment of the present invention will be better understood when read in conjunction with the appended drawings. For the purpose of illustrating the invention, there are shown in the drawings embodiments, which are presently preferred. It is understood, however, that the invention is not limited to the precise arrangements and instrumentalities shown. In the drawings.

DETAILED DESCRIPTION OF THE PREFERRED EMBODIMENTS

Figure 1:
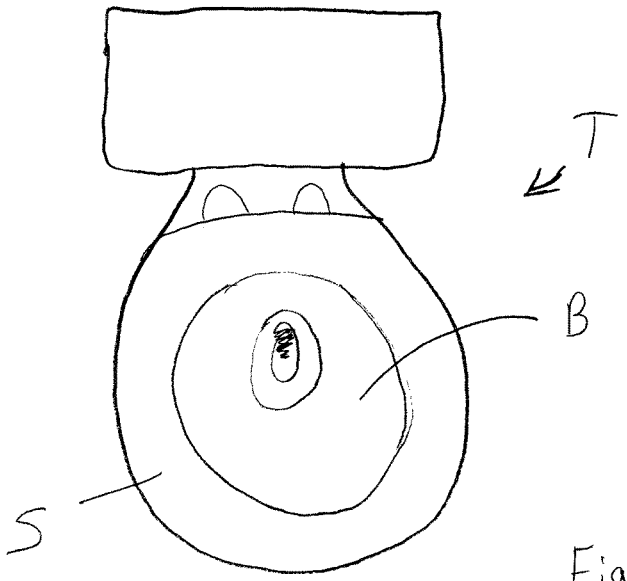
FIG. 1 is a plan view of a toilet.

Certain terminology is used in the following description for convenience only and is not limiting. The words "right," "left," "top," and "bottom" designate directions in the drawings to which reference is made. The words "a" and "one," as used in the claims and in the corresponding portions of the specification, are defined as including one or more of the referenced item unless specifically stated otherwise. An article may be referred to as "disposable" meaning that it is easily discarded or thrown away and is not intended for multiple uses. Thus, an article formed of hard, molded plastic or similar material would not be considered disposable. An article may be referred to as "biodegradable" meaning that it is easily broken down chemically by the environment. Finally, a substance or article may be referred to as "water-soluble" meaning that it is partially, substantially, or completely dissolvable in water. This terminology includes the words above specifically mentioned, derivatives thereof, and words of similar import. The phrase "at least one" followed by a list of two or more items, such as "A, B, or C," means any individual one of A, B or C as well as any combination thereof.

Figure 2:
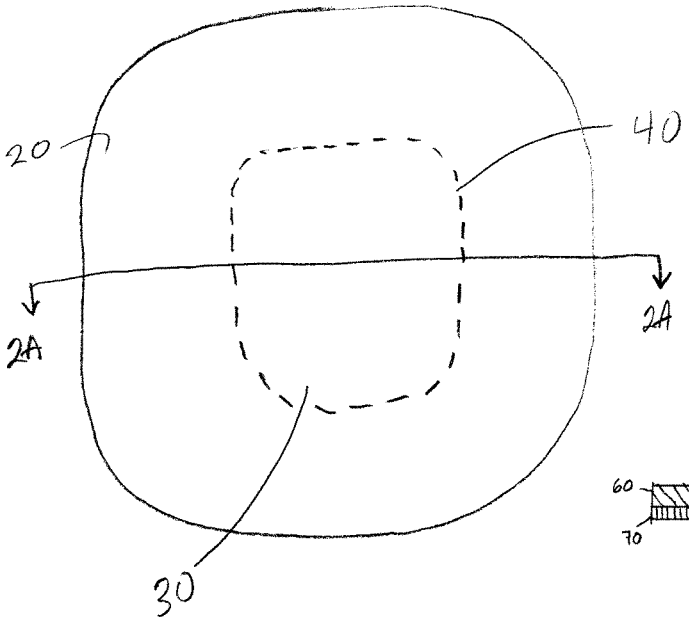
FIG. 2 is a plan view of an embodiment of the cover/sanitizer of the present invention.
Figure 2A:
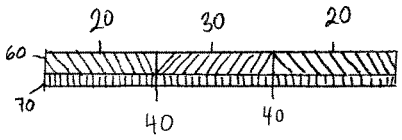
FIG. 2A is a section view taken along line 2A-2A in FIG. 2.

FIG. 1 to depicts a toilet T having a seat S. The bowl portion B is where waste is received. FIG. 2 represents a first embodiment of the cover/sanitizer 10. The cover/sanitizer 10 is comprised of two separate portions 20, 30. A perforation 40 separates portions 20, 30. The cover/sanitizer 10 has multiple layers 60, 70, which provide both comfort and a barrier against impurities and wetness, which may exist on the toilet seat. The cover/sanitizer 10 has a base layer 60 made from any number of flushable, biodegradable materials such as, but not limited to: rice paper, pulp tissue, non-woven fabric, cellulose, polysaccharide films, bagasse, hemp, etc. The base layer 60 is coated by a water-impervious barrier layer 70. The water impervious coating layer 70 is formed by coating the base layer 60 with one or more suitable filmic layer. Examples of suitable coatings that form water impervious coated layers are emulsions and dispersions of polymers, such emulsions of polyethylene, styrene butadiene, acrylics and polyvinyl chloride. Additionally, the coating could be comprised of a water repellant material such as wax, or silicone or a similar hydrophobic material.

Seat cover portion 20 is configured to be arranged on top of a toilet seat S, whereas sanitizer portion 30 is configured to be separated from the seat cover portion 20 via perforations 40. Portion 30 is used as a sanitizer, having been previously treated (pretreated) with a disinfectant and or a cleaning agent. Some examples of suitable detergents/disinfectant agents include but are not limited to: surfactants, isopropyl alcohol, sodium hypochlorite, alkyl dimethyl benzyl ammonium chloride, alkyl dimethyl ethylbenzyl ammonium chloride; triclosan, etc. Alternatively, portion 30 can be treated with aloe, gentle lotions or cleaners and can be used as a personal hygienic product. In some embodiments, the cover/sanitizer 10 has a single rather than multiple layers. Also, in some embodiments, the treated portion may also include at least part or all of portion 20.

Figure 3:
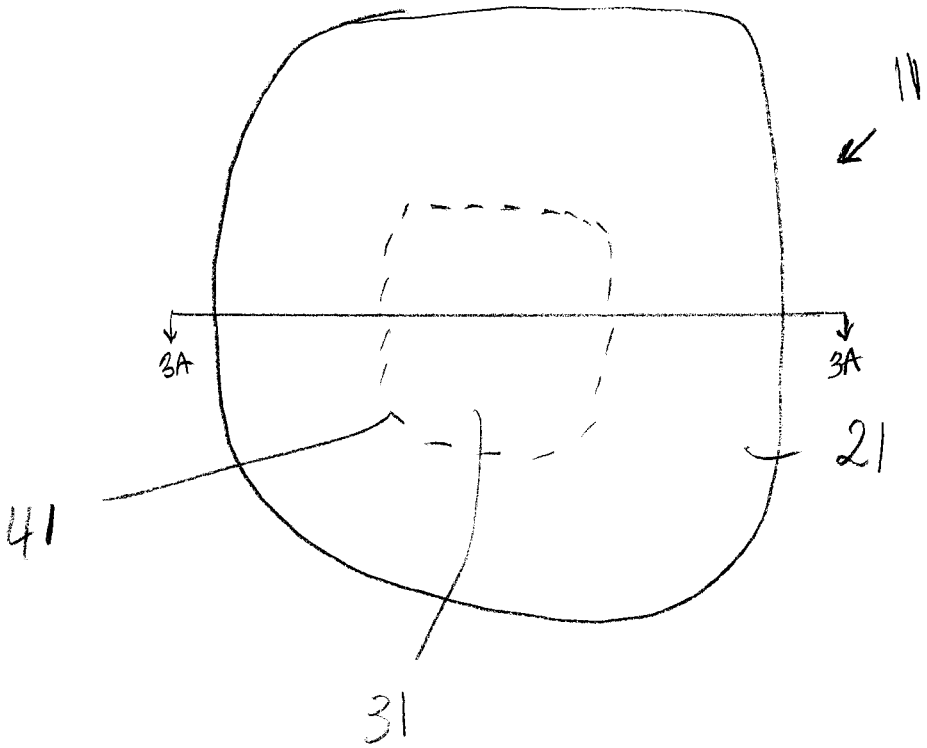
FIG. 3 is an alternate embodiment of the cover/sanitizer of FIG. 2.
Figure 3A:
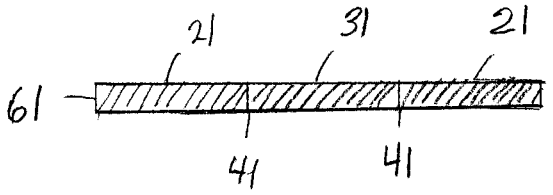
FIG. 3A is a section view taken along line 3A-3A in FIG. 3.

FIG. 3 is an alternate embodiment of the cover/sanitizer as shown in FIG. 2. This embodiment includes a cover/sanitizer 11 with a seat cover portion 21 and sanitizer portion 31, which however only includes a single layer 61. In the embodiment of FIG. 3, as in the embodiment of FIG. 2, the seat cover portion 21 is configured to be arranged on top of a toilet seat S, whereas sanitizer portion 31 is configured to be separated from the seat cover portion 21 via perforations 41. Portion 31 is used as a sanitizer, having been previously treated (pretreated) with a disinfectant and or a cleaning agent. Some examples of suitable detergents/disinfectant agents include but are not limited to: surfactants, isopropyl alcohol, sodium hypochlorite, alkyl dimethyl benzyl ammonium chloride, alkyl dimethyl ethylbenzyl ammonium chloride; triclosan, etc. Alternatively, portion 31 can be treated with aloe, gentle lotions or cleaners and can be used as a personal hygienic product. In some embodiments, the treated portion may also include at least part or all of portion 21.

Figure 4:
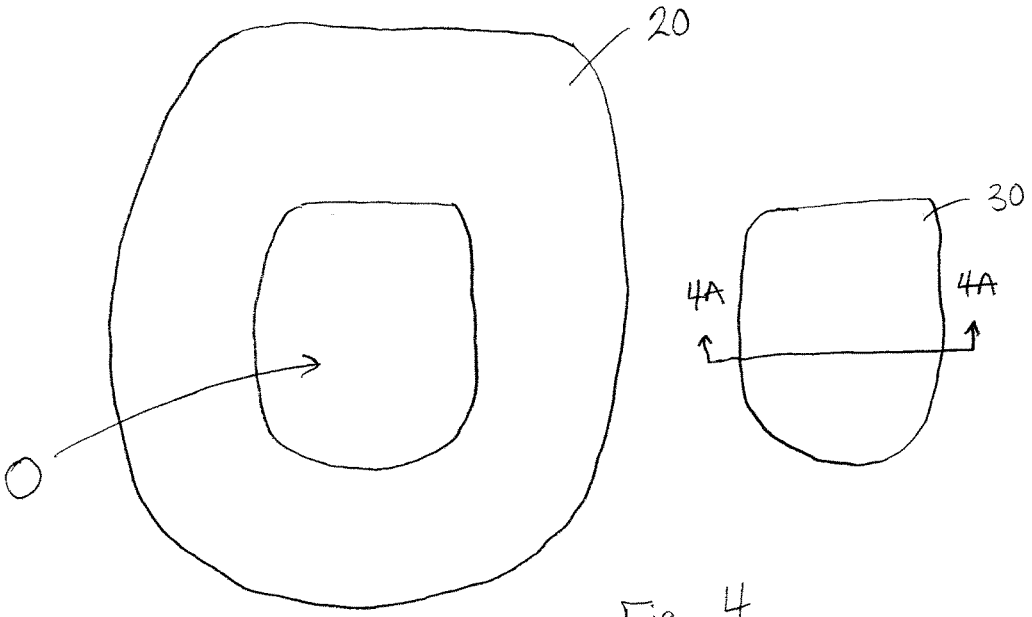
FIG. 4 is a view similar to FIG. 2 where components are separated from each other.
Figure 4A:
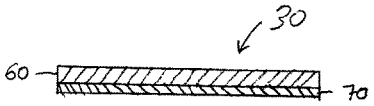
FIG. 4*a* is section view taken along line 4A-4A in FIG. 4.

As shown in FIG. 4, once the sanitizing portion is removed, an opening O is created in the seat cover portion 20. The sanitizing portion 30, as shown in FIG. 4A, is configured as having a backing layer or barrier layer 70 on top of base layer 60. In the case of the sanitizing portion 30, the base layer 60 is treated with a detergent or a disinfectant as set forth above. Only the sanitizing portion 30 need be treated with the disinfectant or cleaning agent. The detergent or disinfectant can be applied in a conventional matter, e.g. sprayed on, spot applied, rolled, etc.

Figure 5:
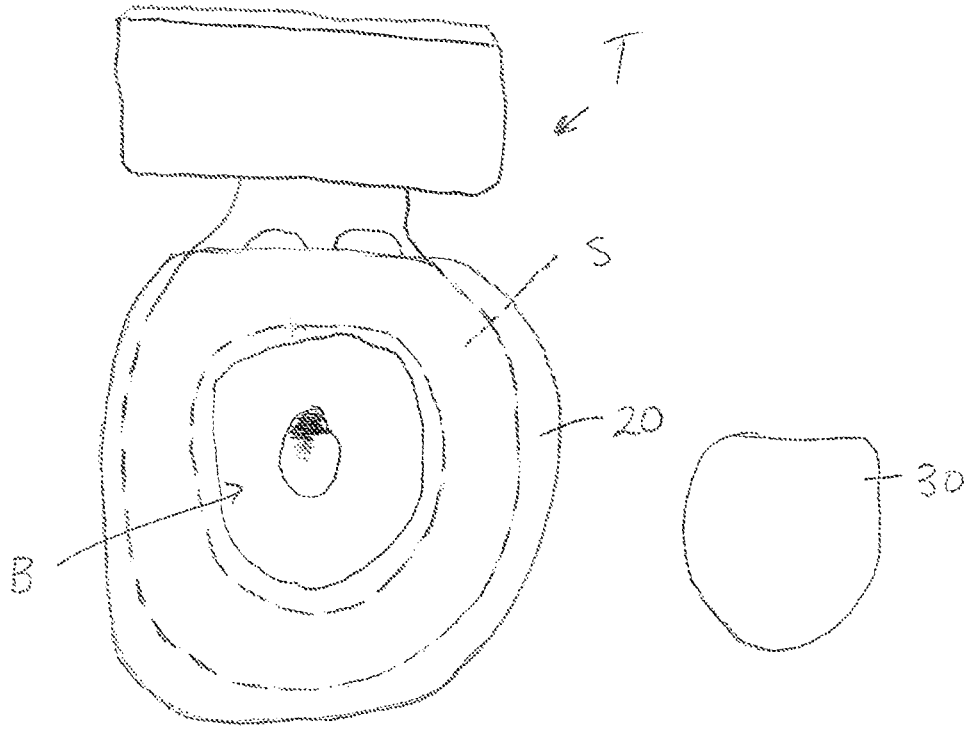
FIGS. 5 and 6 show the separated components in use in their operating positions.
Figure 6:
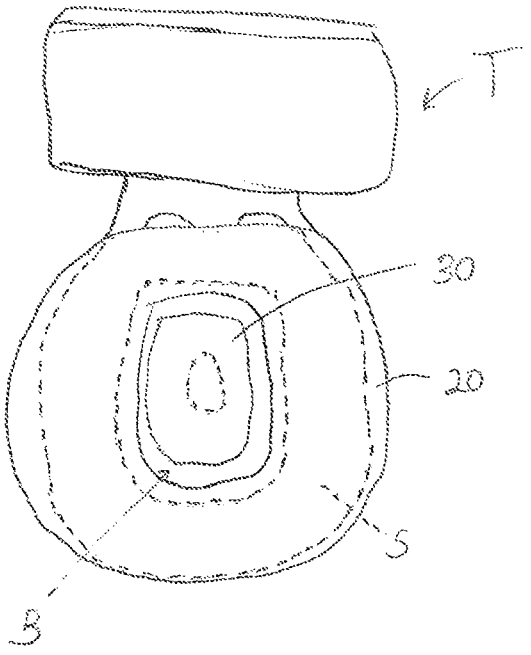

As a result, once separated from the seat cover portion 20, the sanitizing portion 30 can be placed in the bowl B of the toilet T in order to disinfect and partially clean the bowl just by the mere introduction of the disinfecting agent impregnated in the base layer 60. Further, since the hydrophobic barrier layer 70 will cause the sanitizing portion 30 to float on the water in the bowl, the sanitizing portion 30 thereby creates a barrier between the toilet bowl water and the user. (See FIGS. 5 and 6) This prevents splashing during use and further serves to introduce detergent or disinfectant into the bowl B. As already mentioned above, in some embodiments, the seat cover portion has a single layer of (seat cover portion 21) in which case opening O is created in the seat portion 21 in a similar manner to the opening O created in seat portion 20 with sanitizing portion 31 being placeable in bowl B of the toilet T. As already mentioned, in some embodiments, the treated portion may also include at least part or all of portion 20.

In yet some other embodiments, the sanitizing portions 30,31 are partially separable from the seat cover portions 20, 21 and hang down into bowl T. In some embodiments, the sanitizing portions 30,31 that are at least partially separable are configured to hang down and at least partially float on the water in the bowl.

Figure 7:
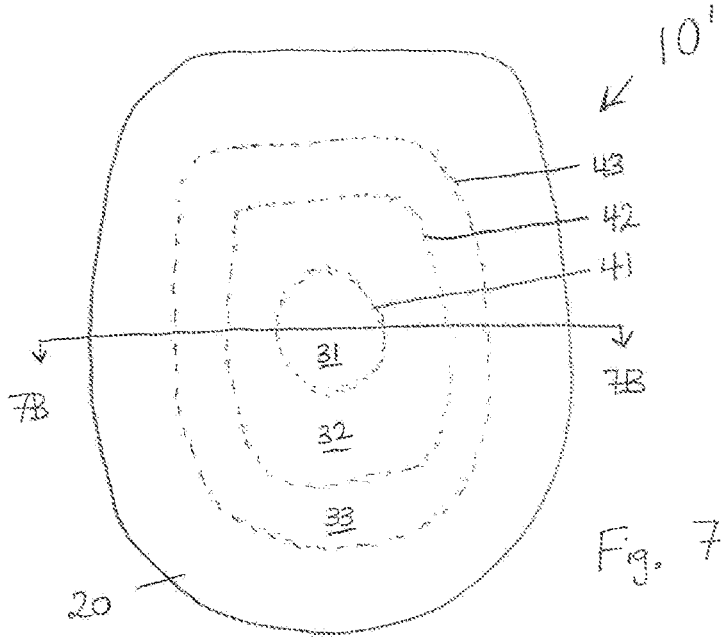
FIG. 7 is a plan view of an alternate embodiment of the of the cover shown in FIG. 2.
Figure 7A:
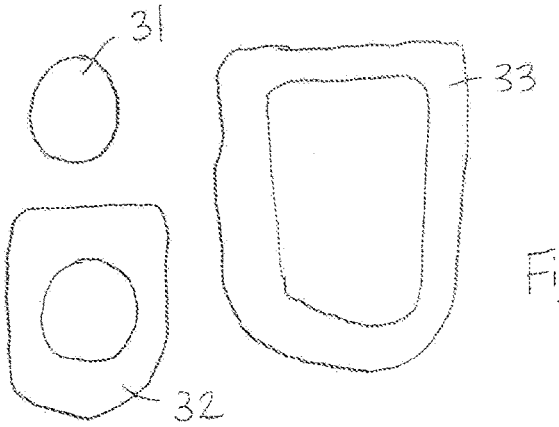
FIG. 7A is a detail view of components shown in FIG. 7.
Figure 7B:
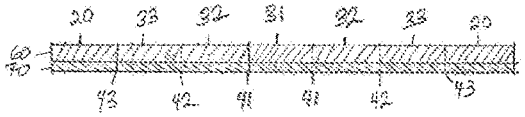
FIG. 7B is a section view taken along line 7B-7B in FIG. 7.

Turning now to FIG. 7, which depicts another embodiment of the cover/sanitizer 10' in which a plurality of sanitizing portions 31, 32, 33 are provided. A first, generally centrally located, ring of perforations 41 defines the first inner sanitizing portion 31. A second ring of perforations 42, having a diameter greater than the first ring 41, defines a second sanitizing portion 32 encircling the first sanitizing portion 31. A third ring of perforations 43, having a diameter greater than the second ring 42 such that a second annular region 33 or zone is provided encircling the second region 32.

While the rings may be generally circular or square like or other shapes, by providing different annular inner regions 31-33 pretreated with detergent or disinfectant, a user has different options for using the accessory as a disinfecting device in addition to the toilet seat covering function. For example, if a user is in a rush, he or she can quickly and easily punch out the smaller central inner region 31 because it is centrally located and has a small circumference of perforations or zones of weakness. In other situations, for example a backsplash with more surface area is needed (for example because the toilet shape is less than conventional or because the water level is higher in the bowl and so the surface area of the water level may be larger than normal) the user has the option to punch or tear the outer perforation of inner region 32 whilst leaving 31 connected to 32 so that the resulting region of pretreated material having a surface area that is larger than central inner region 31 is entirely separated from the cover seat outer region 33 and middle region 32.

The larger surface area of pretreated material can then be placed inside the toilet bowel to cover a larger surface area whereas the outer region 33 and middle region 32 can serve as the seat cover 20. If a pretreated material surface area even larger than 31-33 region is required, then the user has the option to punch or tear the outer perforation of the largest sanitizing portion 33 while leaving regions 31 and 32 connected to 33 so that the resulting region of pretreated material having a surface area of sanitizing portions 31, 32, and 33 combined.

The larger surface area of sanitizing portions 31, 32, and 33 combined can then be placed inside the toilet bowl to cover an even larger surface area whereas the outermost portion can serve as the seat cover 20. Adopting multiple inner regions also provides a user with options on configuring how large a surface area the seat cover region may be. For example, round toilet seats may be fully covered by outer region 34 alone, whereas oval shaped toilet seats may be more adequately covered. Providing multiple perforated annular regions allows the user to configure the toilet seat cover and backsplash disinfectant material more precisely according to the shape of the toilet seat and the bowl profile and/or water level.

In some embodiments, the cover/sanitizer of FIG. 7 is made up of multiple layers in a similar way to cover/sanitizer 10. In other embodiments, the cover/sanitizer has a single layer in the same way as cover/sanitizer 11. In yet other embodiments, the sanitizing portions may extend further outwardly and form part or all of the cover seat.

Figure 8:
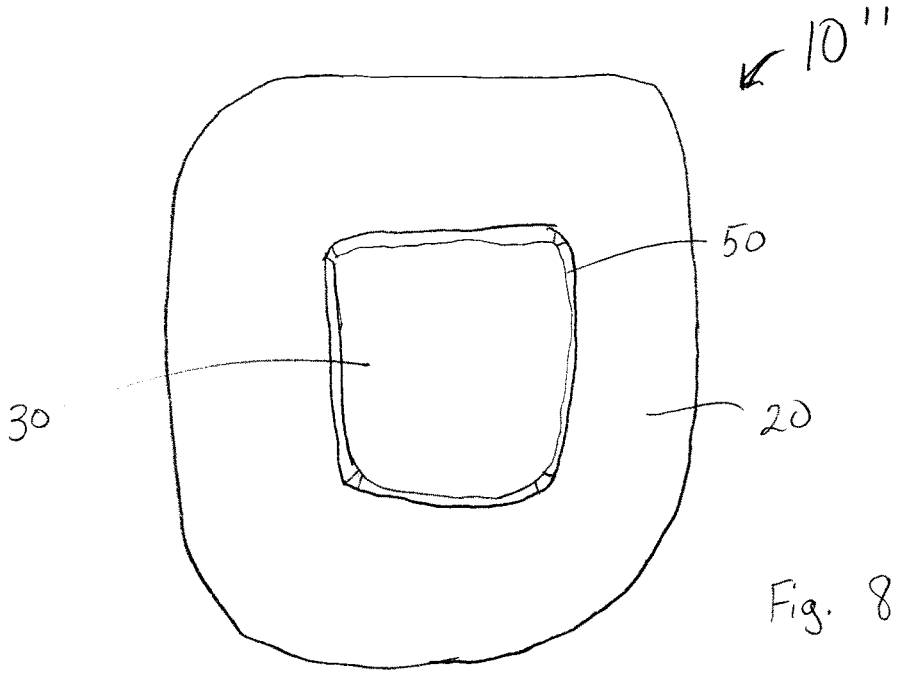
FIG. 8 is a plan view of a second alternate embodiment of the cover shown in FIG. 2.

FIG. 8 depicts another alternate embodiment as shown in FIG. 2. In this embodiment the cover/sanitizer 10" includes a frangible zone 50 instead of a perforation that encircles the sanitizing portion 30. Given the type of material used for the base layer, it might be more advantageous to provide a frangible zone 50 instead of perforations depending on the type of material used for the base layer and on the type of detergent or disinfectant used. In some embodiments, the cover/sanitizer of FIG. 8 is made up of multiple layers in a similar way to cover/sanitizer 10. In other embodiments, the cover/sanitizer has a single layer in the same way as cover/sanitizer 11.

Figure 9:
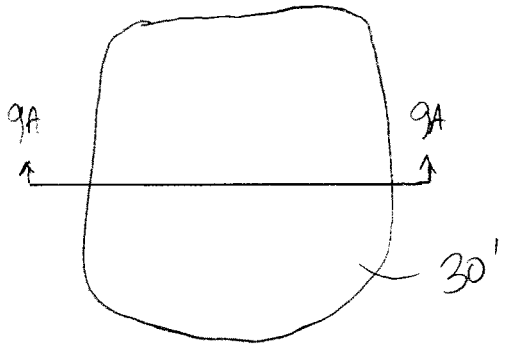
FIG. 9 is a plan view of a stand-alone bowl sanitizer of the present invention.
Figure 9A:
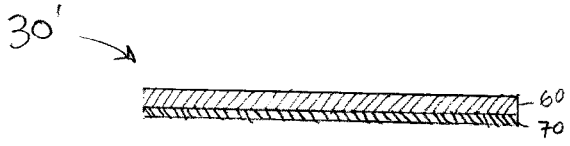
FIG. 9A is a section view taken along line 9A-9A in FIG. 9.

The sanitizing portion can also be provided independent of the seat cover 20. FIGS. 9 and 9A show a sanitizing portion 30' that is packaged separately from the seat cover portion 20. The sanitizing portion 30' can be configured in addition to the seat cover/sanitizer 10, thereby providing an additional sanitizing portion, or can be packaged individually. As an individual component, the sanitizing portion 30' can be used to introduce detergents and/or disinfectants to the toilet bowl. In some embodiments, the sanitizing portion FIG. 9 is made up of multiple layers in a similar way to cover/sanitizer 10. In other embodiments, the sanitizing portion has a single layer in the same way as cover/sanitizer 11.

Figure 10:
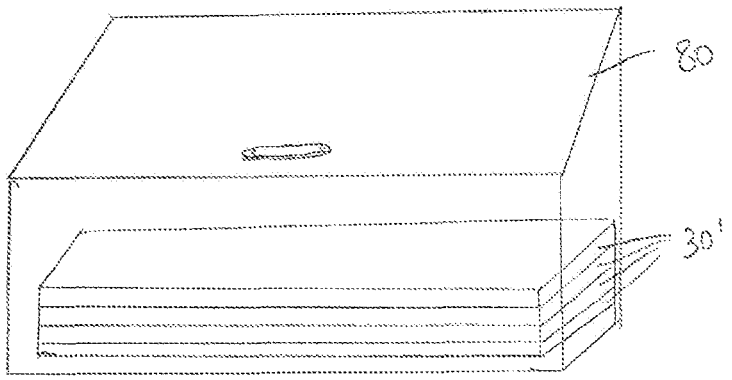
FIG. 10 is a view of the bowl sanitizer of FIG. 9 packaged.
Figure 11:
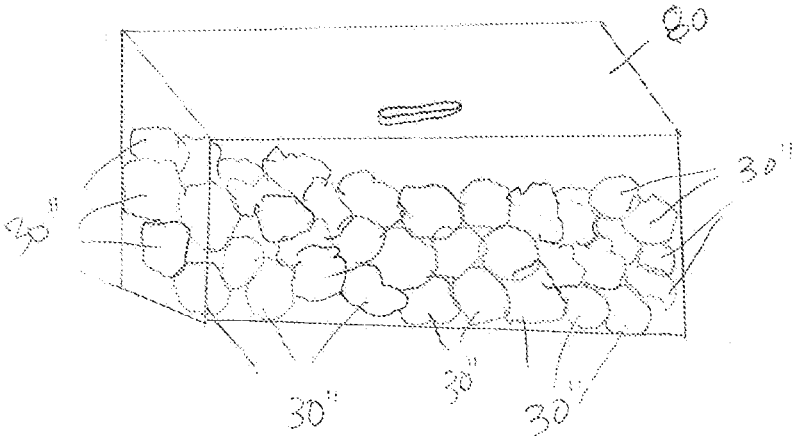
FIG. 11 is an alternate embodiment of the bowl sanitizer of FIG. 9, packaged.
Figure 12:
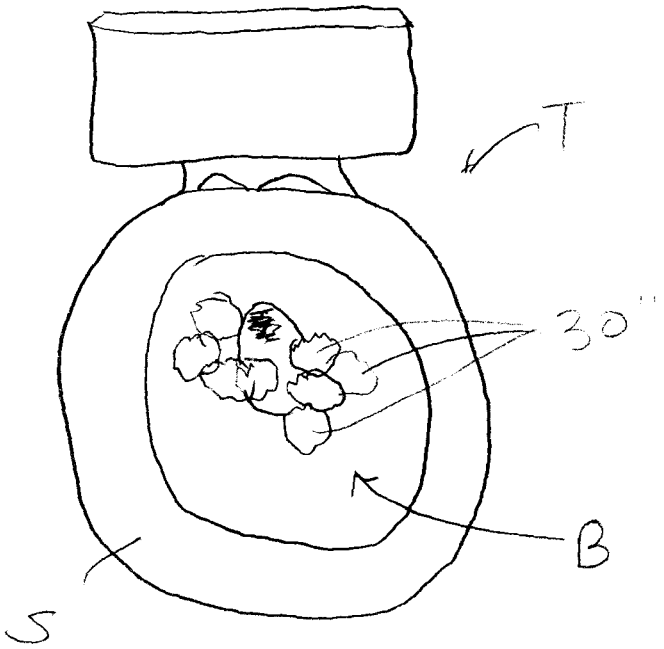
FIG. 12 is a plan view of the bowl sanitizer of FIG. 11 in use.

FIG. 10 depicts an embodiment in which the sanitizing portions 30' are packaged flat in a box 80. In use, the sanitizing portions 30' are removed from the box 80 by a user and then placed inside the bowl B to form a backsplash prevention layer of desired surface area and shape in addition to introducing detergent and/or disinfectant to the bowl B. In the embodiment of FIG. 11, the sanitizing portions 30" are pre-crumpled and packaged in a box 80. As depicted in FIG. 12, in use the crumpled sanitizing portions 30" are likewise removed from the box 80 and as above, placed in the bowl B to create a backsplash prevention layer of desired surface area and shape in addition to introducing detergent and/or disinfectant to the bowl B. In some embodiments, the sanitizing portions of FIG. 10 and/or FIG. 11, are made up of multiple layers in a similar way to cover/sanitizer 10. In other embodiments, one, a plurality, or all of the sanitizing portions has a single layer in the same way as cover/sanitizer 11.

Figure 13:
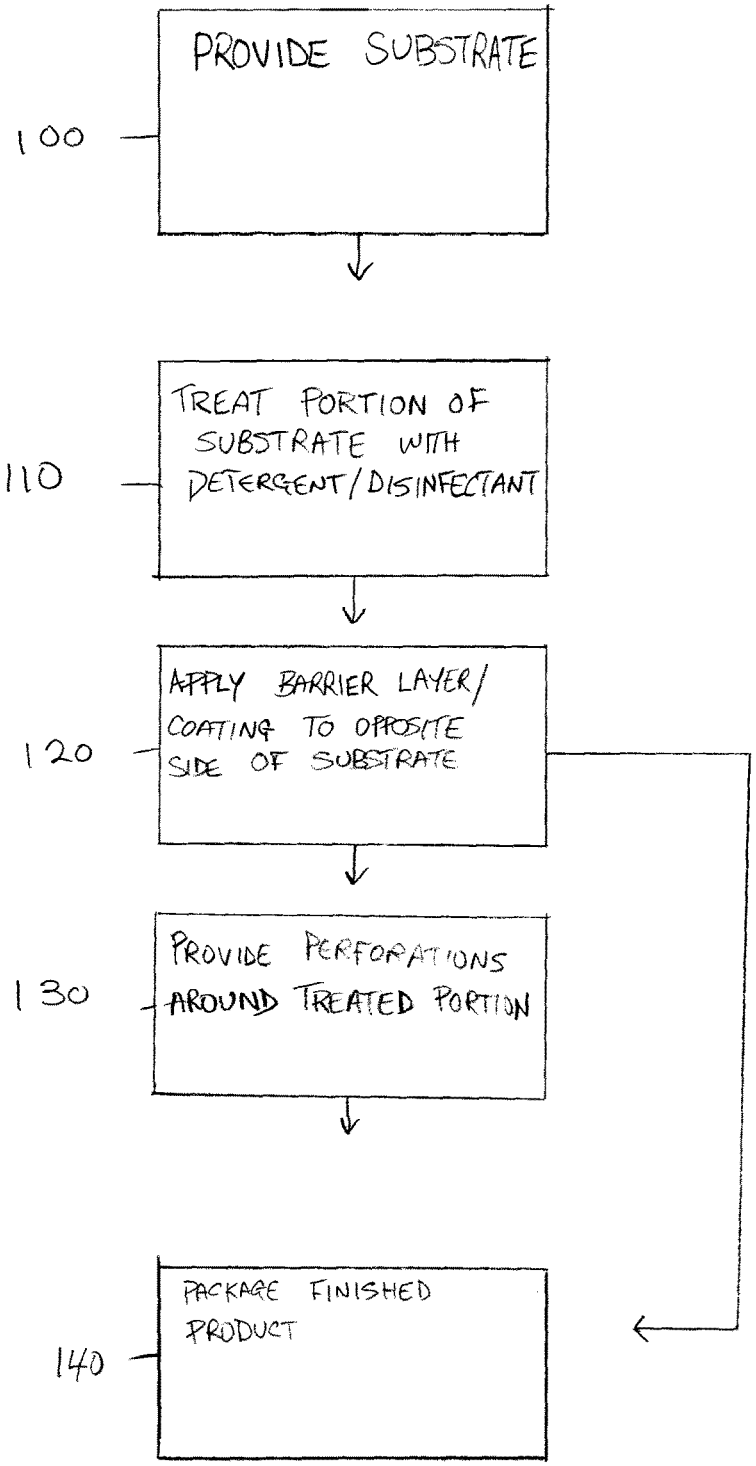
FIG. 13 is a flow diagram describing the process for preparing the present cover/sanitizer.

FIG. 13 depicts a flow diagram for a method for preparing the cover/sanitizer 10. Accordingly, a substrate or base layer 60 is provided 100. The substrate or base layer 60 can be provided as individual sheets or as a continuous web of material from a roll. The substrate is then, at least partially, treated with a detergent and/or a disinfectant 110. The detergent and/or a disinfectant is locally absorbed into the material of the base layer 60. A barrier layer 70 is then applied 120 to the side of the base layer 60 opposite to the side that was treated with the detergent and/or disinfectant. Perforations are then provided 130 around the treated portion, the perforation 40 thereby defining a boundary between the seat cover portion 20 the sanitizing portion 30. The cover/sanitizer 10 is then packaged 140. In an alternative method, the entire substrate or base layer 60 can be treated in step 110 and the step of providing perforations 130 can be omitted.

Figure 14:
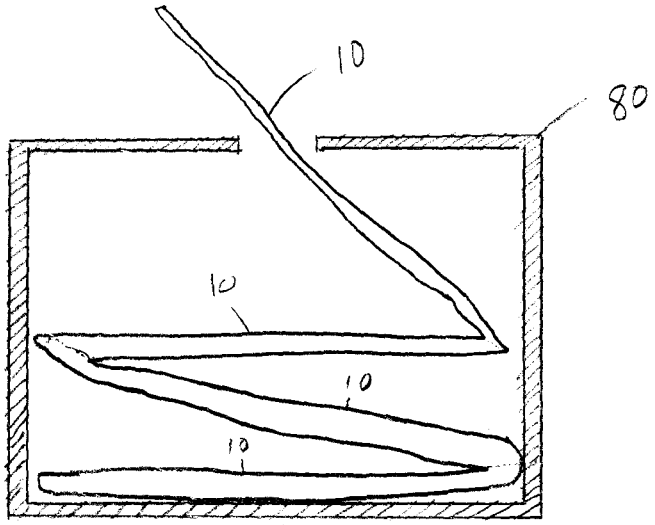
FIG. 14 is a partial section view of a dispenser for the present cover/sanitizer.
Figure 15:
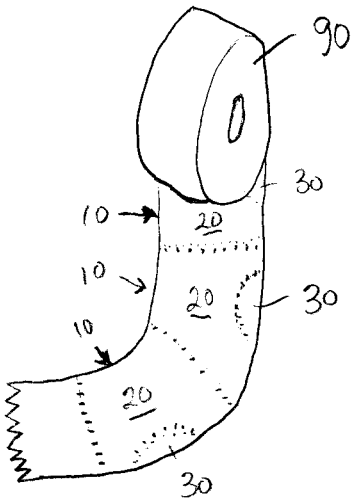
FIG. 15 is a perspective view of a roll dispenser for the present cover/sanitizer.

FIG. 14 depicts a section view of a plurality of cover/sanitizers 10 detachably interconnected and packaged in a box 80. The cover/sanitizers 10 are accordion folded and can be detached from one another via perforations. Alternatively, as shown in FIG. 15, the cover/sanitizers 10 can be folded in half and rolled in order to be dispensed via a roll device 90. This embodiment is advantageous in that the cover/sanitizer 10 is folded thereby creating a more easily grippable area and therefore facilitates separating the sanitizing portion 30 from the seat cover portion 20. In some embodiments, one or more of the cover/sanitizers of FIG. 14 are each made up of multiple layers in a similar way to cover/sanitizer 10. In other embodiments, one or more of the cover/sanitizers has a single layer in the same way as cover/sanitizer 11.

It is understood, therefore, that this invention is not limited to the particular embodiments disclosed, but is intended to cover all modifications which are within the spirit and scope of the invention as defined by the appended claims; the above description; and/or shown in the attached drawings.

What is claimed is:

1. A disposable toilet seat cover/sanitizer comprising a layer, the disposable toilet seat cover/sanitizer having at least at least one portion thereof treated with a detergent and/or a disinfectant, the at least one treated portion being generally centrally arranged, the layer having perforations or frangible zone, wherein the perforations or fragile zone is configured to allow the treated portion(s) to be detached from the disposable toilet seat cover/sanitizer, thereby creating a central opening; and wherein said layer comprises a base layer and said toilet seat cover/sanitizer further comprising a barrier layer adjacent to said base layer, wherein the at least one treated portion is surrounded by a non-treated portion, the treated and untreated portions being delimited by said perforations or said frangible zone, and wherein the at least one treated portion is configured to be detached from the disposable toilet seat cover/sanitizer using said perforations or said frangible zone to thereby create the central opening in the untreated portion.

2. The disposable toilet seat cover/sanitizer of claim 1, wherein the layer is comprised of at least one of the following: paper, rice paper, pulp tissue, non-woven fabric, cellulose, polysaccharide films, bagasse, and hemp.

3. The disposable toilet seat cover/sanitizer of claim 1, wherein the detergent and/or disinfectant is selected from the group consisting of: surfactants, isopropyl alcohol, sodium hypochlorite, alkyl dimethyl benzyl ammonium chloride, alkyl dimethyl ethylbenzyl ammonium chloride; triclosan; and combinations thereof.

4. The disposable toilet seat cover/sanitizer of claim 1, wherein the untreated portion, once separated from the treated portion, is configured as a toilet seat cover.

5. The disposable toilet seat cover/sanitizer of claim 1, wherein the at least one treated portion is comprised of multiple detachable concentric treated portions.

6. The disposable toilet seat cover/sanitizer of claim 1, wherein the barrier layer is water impermeable and comprised of at least one of the following: emulsions and dispersions of polymers, emulsions of polyethylene, styrene butadiene, acrylics and polyvinyl chloride, wax, and silicone.

7. The disposable toilet seat cover/sanitizer of claim 6, wherein the at least one treated portion is configured for placement in a toilet prior to use thereby creating a splash barrier.

8. A method for preparing a toilet seat cover/sanitizer comprising:

providing at least one substrate or layer portion;

arranging generally centrally at least one treated or treatable portion of said at least one substrate or layer portion surrounded by a non-treated portion of said at least one substrate or layer portion, treating the at least one treatable portion of said at least one substrate or layer portion with a detergent and/or a disinfectant, the detergent and/or a disinfectant being locally absorbed into the material of the substrate or layer portion;

delimiting the at least one treatable or treated portion from the non-treated portion using perforations or a frangible zone;

configuring the treated portion to be detachable from the disposable toilet seat cover/sanitizer using said perforations or frangible zone to thereby create a central opening in the untreated portion;

and packaging the cover/sanitizer.

9. The method of claim 8, wherein the substrate or layer portion is comprised of at least one of the following: paper, rice paper, pulp tissue, non-woven fabric, cellulose, polysaccharide films, bagasse, and hemp.

10. The method of claim 9, wherein the substrate or layer portion comprises a base layer and further comprising applying a barrier layer to a side of the base layer opposite to the side that is being treated with the detergent and/or disinfectant.

11. The method of claim 10, wherein the barrier layer is water impermeable and is comprised of at least one of the following: emulsions and dispersions of polymers, emulsions of polyethylene, styrene butadiene, acrylics and polyvinyl chloride, wax, and silicone.

12. A disposable toilet seat cover/sanitizer comprising a layer, the disposable toilet seat cover/sanitizer having at least at least one portion thereof treated with a detergent and/or a disinfectant, the at least one treated portion being generally centrally arranged, the layer having perforations or frangible zone, wherein the perforations or fragile zone is configured to allow the treated portion to be detached from the disposable toilet seat cover/sanitizer, thereby creating a central opening:

wherein the at least one treated portion is surrounded by a non-treated portion, the treated and untreated portions being delimited by said perforations or said frangible zone, and wherein the treated portion is configured to be detached from the disposable toilet seat cover/sanitizer using said perforations or said frangible zone to thereby create the central opening in the untreated portion.

* * * * *